US005758873A

United States Patent [19]

Faesser

[11] Patent Number: 5,758,873

[45] Date of Patent: Jun. 2, 1998

[54] METHOD AND DEVICE FOR PROCESSING PRINTED PRODUCTS SUPPLIED IN A HIGH-PERFORMANCE PRODUCT STREAM

[75] Inventor: Daniel Faesser, Küsnacht, Switzerland

[73] Assignee: Ferag AG, Hinwil, Switzerland

[21] Appl. No.: 741,045

[22] Filed: Oct. 30, 1996

[30] Foreign Application Priority Data

Nov. 27, 1995 [CH] Switzerland ..... 03 355/95
Jan. 24, 1996 [CH] Switzerland ..... 00 183/96

[51] Int. Cl.[6] ..... B65H 39/02

[52] U.S. Cl. ..... 270/58.11; 270/29

[58] Field of Search ..... 270/58.01, 58.07, 270/58.11, 58.29

[56] References Cited

U.S. PATENT DOCUMENTS 3,302,539 2/1967 Moffet ..... 270/58.01 X
3,897,945 8/1975 Faltot et al. ..... 270/58.01 X
4,684,118 8/1987 Boss et al. ..... 270/58.01 X
5,106,068 4/1992 Honegger ..... 270/58.01

*Primary Examiner*—Hoang Nguyen
*Attorney, Agent, or Firm*—Walter C. Farley

[57] ABSTRACT

In processing printed products (1) in a high-performance conveying stream the printed products (1) are supplied in a supply stream (Z) with their main surfaces oriented substantially perpendicular to a conveying direction (F). This supply stream (Z) is then transformed into a processing stream (B) by a first rotation of the products (1) in groups around a rotation axis (D) arranged substantially parallel to the main surfaces of the products such that their main surfaces (2) are oriented substantially parallel to the conveying direction (F). In this processing stream (B) the products (1) are processed in groups. After processing, the processing stream (B) is transformed into a removal stream (W) by a second rotation of the products (1) in groups again around a rotation axis (D) arranged substantially parallel to the main surfaces (2) of the products such that their main surfaces are again arranged substantially perpendicular to the conveying direction (F).

21 Claims, 6 Drawing Sheets

Fig.9
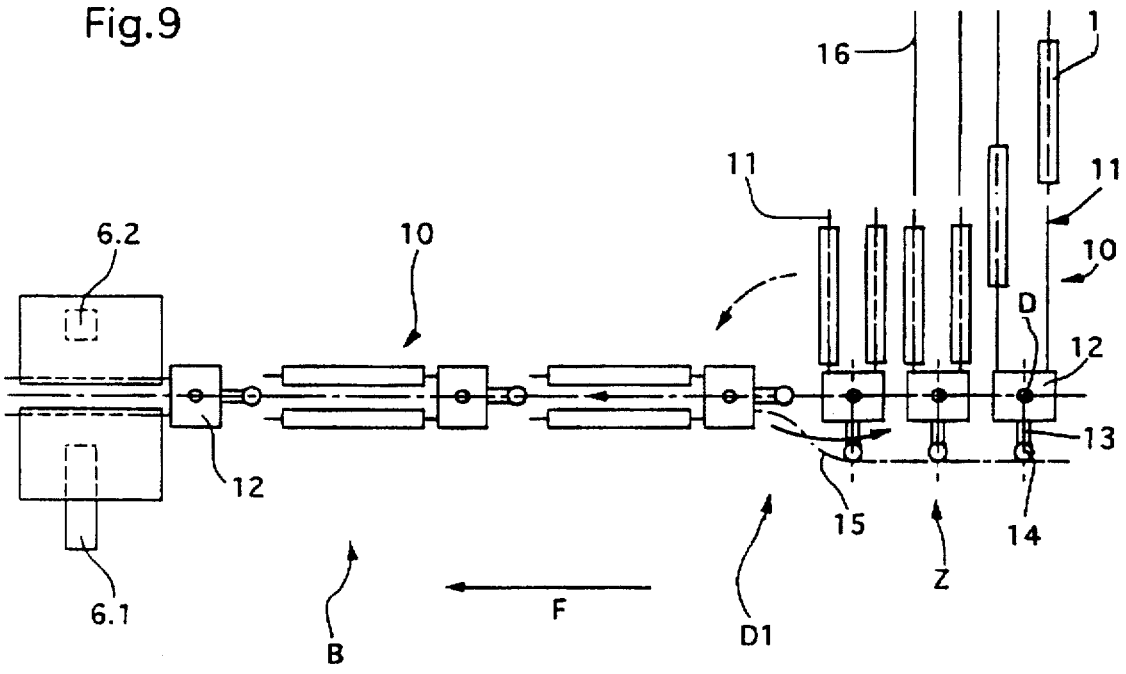
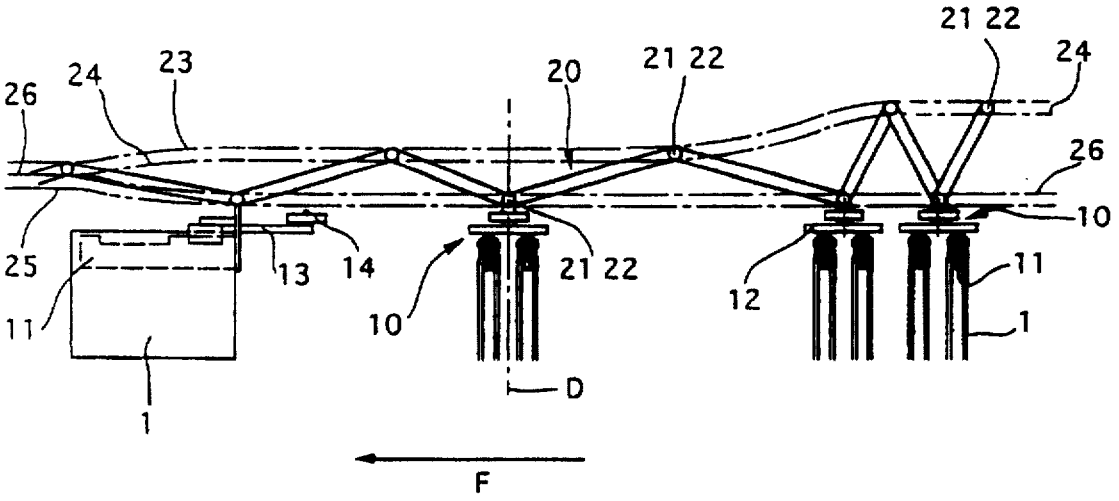
Fig.10

METHOD AND DEVICE FOR PROCESSING PRINTED PRODUCTS SUPPLIED IN A HIGH-PERFORMANCE PRODUCT STREAM

FIELD OF THE INVENTION

The invention is in the field of post-printing processing printed of products and concerns a method device designed for further processing printed products which are supplied in a high-performance conveying stream.

BACKGROUND OF THE INVENTION

High-performance conveying streams of printed products with conveying capacities of 40,000 or more individual printed products per hour are normally scaled streams in which the products are conveyed in a lying position partly overlapping each other or they are conveying streams in which the products are oriented substantially transverse to the conveying direction (main surfaces of the products positioned in planes substantially perpendicular or transverse to conveying direction), whereby the distances between the products are small compared to their length and width. Compared to a conveying stream with printed products oriented parallel to the conveying direction a similar conveying capacity can thus be achieved at a considerably reduced speed, or at the same speed a considerably larger conveying capacity can be achieved respectively. This means for e.g. newspapers which, arranged in a scaled stream or transverse to the conveying direction, are typically conveyed with a distance of ca. 10 cm between two adjacent products a reduction of speed by a factor of ca. three to four maintaining the same conveying capacities. Obviously groups of products or other substantially flat items or groups of such items can be conveyed in the same way as individual printed products.

On the other hand it is considerably more difficult to process printed products in this kind of condensed conveying stream while being conveyed than it is to process them in a conveying stream with the printed products arranged parallel to the conveying direction and conveyed substantially behind each other. In the scaled stream only very restricted processing is possible because the main surfaces of the products overlap each other at least partly. On products conveyed with small distances, substantially perpendicular to the conveying direction, processes which concern one edge of the product can easily be carried out, e.g. stitching folded sheets to form a brochure or gluing an edge of a stack of sheets to form a brochure. If however the main surfaces of the products (e.g. front and/or back cover of brochures) or the inner pages of printed products are to be processed, e.g. printed on, difficulties arise as, for processing each single product a processing tool must be moved into the conveying stream, i.e. between the products to be processed. Between individual processing steps on successive products the tool must be moved out of the stream such that the product to be processed or the processed product can be conveyed past. In order to open products in the form of brochures for processing an inside page, there is no space available in this kind of condensed stream.

Examples of further processing printed products conveyed in a high-performance conveying stream wherein the printed products are arranged transverse to the conveying direction are e.g. collecting, stitching, inserting or cutting and are e.g. carried out with corresponding collecting, stitching, inserting or cutting drums or with corresponding systems with substantially straight conveying lines. All these kinds of processes do not require tools which must interfere with the conveying stream, i.e. which must be inserted between the printed products. Contactless kinds of "processing", such as e.g. a known monitoring method which consists in recording an image of the outermost page of a printed product and using this image together with image processing for monitoring purposes and control conveying and/or processing devices further down stream, do also not require a processing tool which must be inserted between the conveyed products and thus can also be carried out with few restrictions on products in this kind of condensed stream.

SUMMARY OF THE INVENTION

An object of the invention is to provide a method and a device which allow the processing of the main surfaces or inside pages of printed products which are conveyed in a high-performance conveying stream, i.e. with their main surfaces arranged transverse to the conveying direction, with a tool, e.g. a writing head.

The basic idea of the inventive method is to transform a supply stream in which products are conveyed with their main surfaces arranged substantially perpendicular to the conveying direction into a processing stream of product groups conveyed behind each other by rotating the products of the supply stream. In the product groups of the processing stream, the products are supplied with their main surfaces substantially parallel to the conveying direction. The processing stream of product groups is then guided through at least one processing station in which the products are processed substantially as a group. Then, the processing stream is again transformed by rotating the product groups into a removal stream in which again like in the supply stream the main surfaces of the products are arranged perpendicular to the conveying direction. The product groups of the processing stream advantageously comprise a plurality of individual products, they can however, in an extreme case, consist of only one single product. In a product group of the processing stream the relative position of the products can be the same as in the supply stream or e.g. the relative distance between the products and/or the relative position of the products can be changed. After the products have been processed the processing stream is transformed into a removal stream by again rotating the product groups such that in the removal stream the main surfaces of the products are again arranged substantially transverse to the conveying direction.

According to the further processing of the products the transformation of the processing stream into the removal stream can be omitted.

The conveying capacities of the supply stream, the processing stream and the removal stream are identical. The conveying speed of the processing stream is higher, identical or lower than the conveying speed of the supply stream, depending on the format of the products, on the amount of products in a processing group and on the distance between the groups. In most cases, in order to carry out the first rotation of the product groups, room must be made in the conveying stream, either by increasing the conveying speed (increasing the distances between the groups) or by decreasing the distances between the products inside the groups. The extent of the space to be created is dependant on the format of the products to be processed, on the distance between these products in the supply stream, on the number of products in a processing group and on the position of the rotation axis around which the rotation is carried out.

For the transformation of the processing stream into the removal stream the same is applicable. The removal stream e.g. corresponds to the supply stream in what regards distances between products and conveying speed.

The relationships between supply stream, processing stream and removal stream can be expressed with the following formulae:

$$v_B=(v_1 \cdot s_B)/(n \cdot s_I) \text{ or } v_B/v_I=s_B/(n \cdot s_I)$$

and $$v_I=(v_o \cdot s_I)/s_o$$

whereby $v_I$ is the conveying speed in the supply stream, $s_I$ the distance between the products in the supply stream, $v_B$ the conveying speed in the processing stream, $s_B$ the distance between the groups in the processing stream, n the number of products in a processing group, (n being an integer larger than zero), $v_o$ the conveying speed in the removal stream and $s_O$ the distance between products in the removal stream.

Hereby the distance between products and the distance between product groups are to be understood as a distance between two similar points on two successive products in conveying direction, i.e. the distance between e.g. the front edges of two successive products or product groups respectively or the distance between rotation axes of product groups.

The minimum distance between products in the supply stream and in the removal stream is determined by the thickness of the products or by the conveying means (clamps etc.). The minimum distance between product groups in the processing stream is determined by the extension of the products in conveying direction (length or width of the products) or again by the means of conveyance.

If there are buffering means provided between supplying and processing and/or between processing and removing the equal signs in the above equations need only be exact as an average over a length of time, temporally restricted deviations are then handled by the buffering means.

BRIEF DESCRIPTION OF THE DRAWINGS

Preferred embodiments of the method according to the invention and embodiments of the device for carrying out the method are now described in more detail in connection with the following Figures, wherein

FIGS. 9 and 10 are a schematic top plan view and a schematic side elevation, respectively, of a device for carrying out the method according to FIG. 8;

DESCRIPTION OF PREFERRED EMBODIMENTS

FIGS. 1 to 4 show four embodiments of the method of the invention in order to illustrate the dependence of the different conveying speeds on the format of the products, on the position of the rotation axis and on the number of products belonging to one processing group. The figures are bird's eye views or side elevations with an angle of view perpendicular to the conveying direction F and parallel to the main surfaces of the products, such that these main surfaces are not visible. The Figures are to be understood as snapshots of a conveyance with conveying direction F running from left to right.

The figures show the supply stream on the left in with one a potential processing group containing n products is shown hatched as well as their rotation axis D which is substantially parallel to the main surfaces of the products. This is followed on the right side by: the first rotation D.1, the processing stream B in which the products are led past processing tools b, the second rotation D.2 and the removal stream W. For the rotations the corresponding groups are shown with broken lines in a starting position and with unbroken lines in an end position. The rotation angle, the rotation radius and the rotation direction are shown by means of corresponding, rounded arrows in broken lines.

The arrow for the conveying direction F is divided into cycle sections of successive groups. The rotation axes of the groups are moved by these sections in one cycle time, wherein one cycle time equals the number of products in a group divided by the conveying capacity in products per time. The lengths of the sections are given in an arbitrary unit a of lengths. The length of the sections are directly proportional to the conveying speed required locally.

Figure 1:
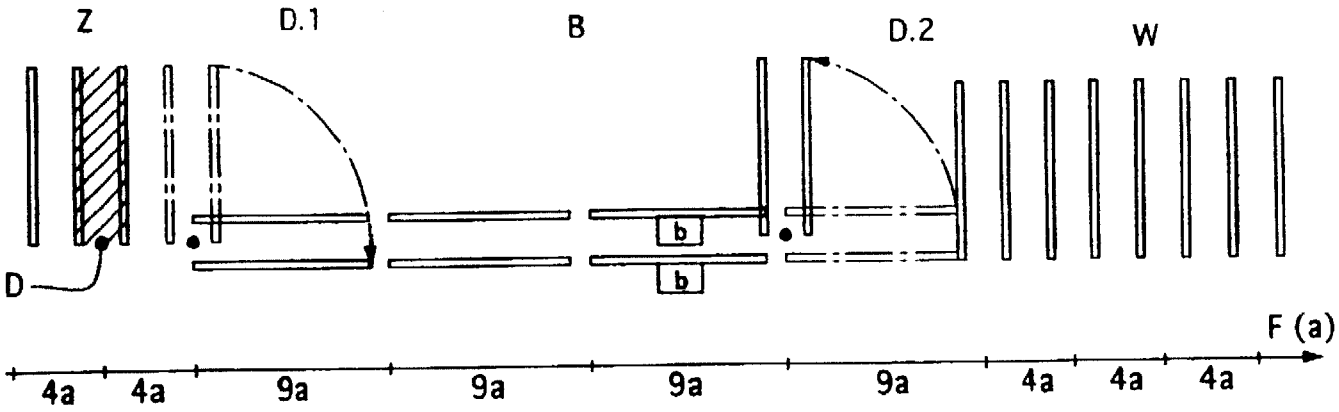
FIGS. 1 to 4 are schematic diagrams of four embodiments of the method according to the invention.

FIG. 1 shows a variant of the method according to the invention with n=2 and a rotation axis D which is visible in the middle of a group edge. The rotation, in this case, requires a lot of space, such that the conveying speed must be increased to 9/4 of the supply speed immediately after the rotation. This speed is maintained for the processing and then reduced to the removal sdeed after the second rotation.

The same method variant can also be carried out with a rotation in the opposite direction (counterclockwise). As a variant of this kind requires space for the rotation behind the group to be rotated the group must be accelerated before rotation.

Figure 2:
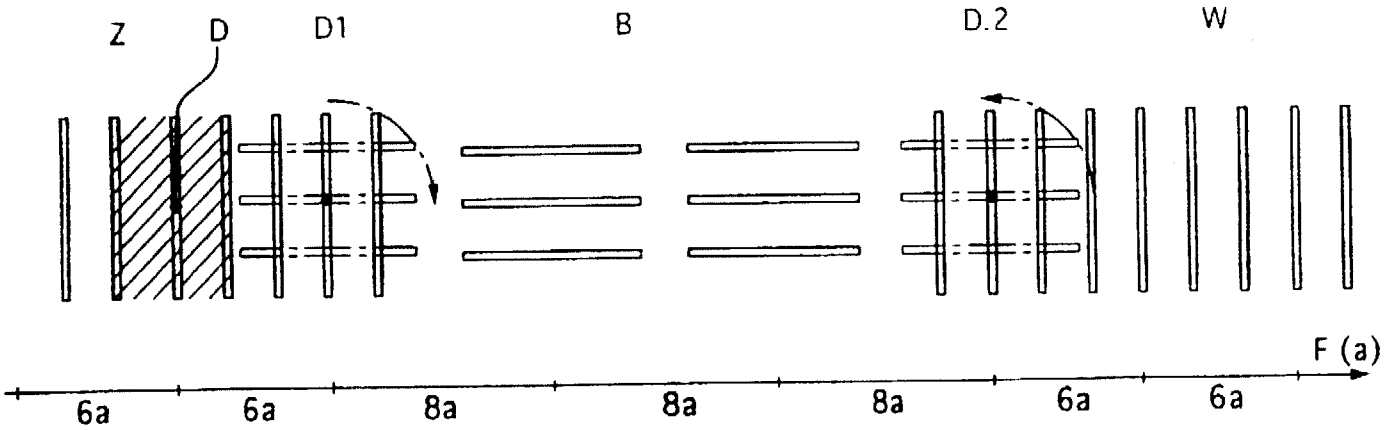

FIG. 2 shows a variant of the inventive method with n=3 and a rotation axis which is visible in the center of a group side. The rotation requires less space than the one shown in FIG. 1 and thus the conveying speed needs only to be increased to 8/6 of the supply speed.

Figure 3:
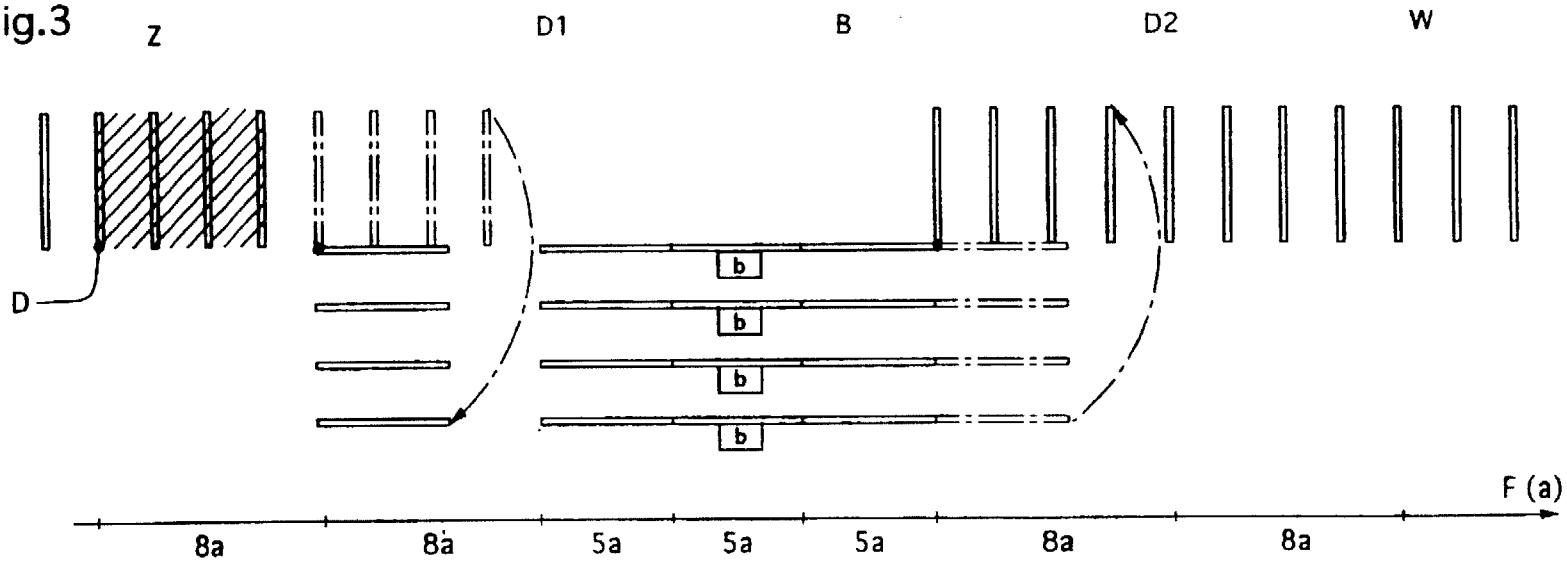

FIG. 3 shows a variant of the inventive method with n=4 and a rotation axis which is visible in a group comer. The rotation, in this case, requires no additional space such that the conveying speed need not be increased. In the processing stream B the products are conveyed with a minimal distance (equal to the extent of the products in conveying direction) such that, in the case shown, the conveying speed of the processing stream is 5/8 of the supply speed and thus is lower than this speed.

Figure 4:
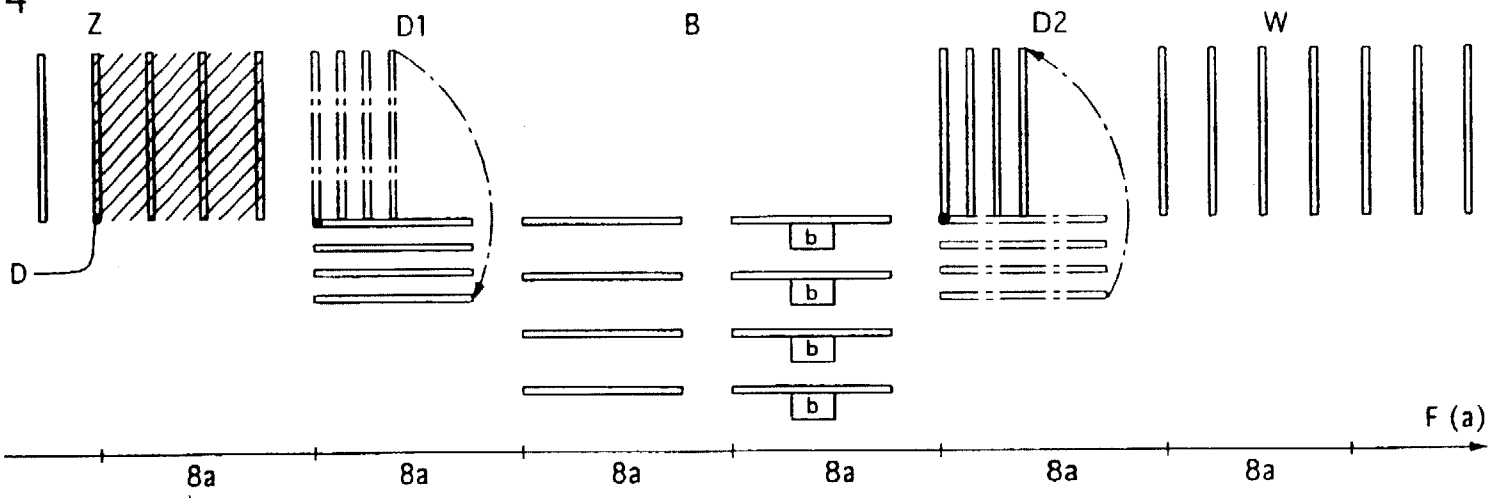

FIG. 4 shows a variant of the inventive method with n=4 and a rotation axis which is arranged identically to the one in the variant according to FIG. 3. Although the products are larger than in FIG. 3 the rotation can be carried out without additional space because the distances between the products in the group are reduced for the rotation such that more space is created between the groups. Obviously the conveying speed is constant according to this variant.

Different characteristics of the method variants shown in FIGS. 1 to 4 can also be combined differently to create further method variants. It is also obvious that the rotation axis can also be arranged in different, not shown manner, e.g. outside the group and that the processing groups can also comprise other numbers of products, especially only one product. It can also be imagined that the rotation axis of the first rotation is not the same axis as the one used for the second rotation. In any case the rotations D.1 and D.2 can be carried out in the opposite direction to the direction shown.

From FIGS. 1 to 4 it can be seen that the processing tools are substantially arranged to be stationary and that the products are led past them. If a certain processing tool requires a certain conveying speed (conveying speed of the processing stream $v_B$) this speed can be adjusted by a corresponding choice of number n and of the distances $s_B$ between the groups to a high degree independently of the conveying speed.

A device for carrying out the method according to the invention comprises a plurality of supporting means which are conveyable along a conveying line and rotatable around rotation axis substantially transverse to the conveying direction (parallel to the main surfaces of the products), whereby with each of these supporting means a group of spaced printed products are supported in at least one position. Furthermore the device comprises controlling means for controlling the rotation of the supporting means, e.g. corresponding guiding rails.

For method variants with a constant conveying speed (FIG. 4) these supporting means are e.g. arranged on a conveying chain which is driven at a constant conveying speed.

For methods with varying conveying speed supporting means which e.g. run on a rail and are connected to each other by connecting means with variable length in conveying direction must be used. Supporting means connected thus are driven at varying speed in many ways, all known to one skilled in the art.

Figure 5:
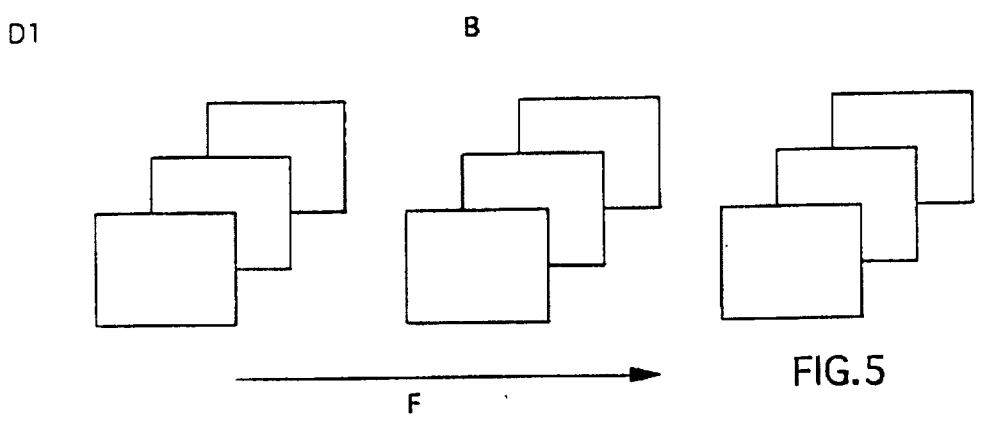
FIGS. 5 to 7 are schematic representations of arrangements of products in the groups of the processing stream.
Figure 6:
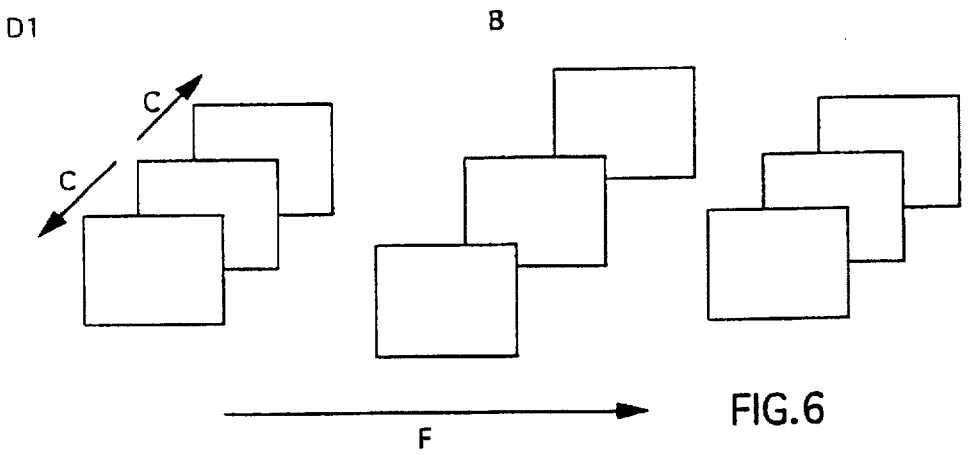
Figure 7:
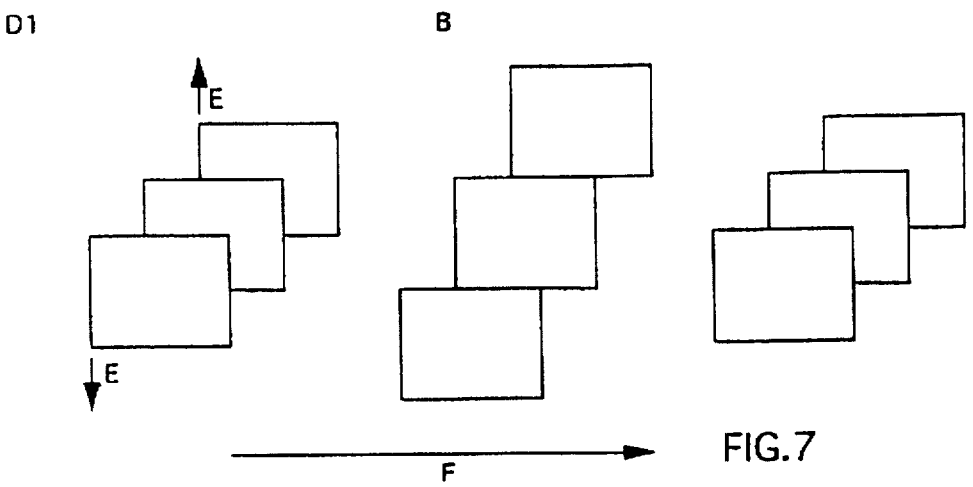

FIGS. 5 to 7 show different variants for conveying the product groups of the processing stream past processing tools. From left to right (conveying direction F) one product group after the first rotation, one product group in processing position and one product group before the second rotation is shown.

FIG. 5 shows a variant in which the relative product position in the group is not changed, i.e. in which the products in the group are arranged in the same manner as they are arranged in the supply stream and in the removal stream. FIG. 6 shows a variant in which the product distances in the group are enlarged for processing (arrows C). FIG. 7 shows a variant in which the products of the group are shifted transverse to the distance between them and thus are staggered (arrows E). Shifting in conveying direction would also be possible, but is however restricted by the density of the processing stream.

By shifting the products in the processing groups, as shown in FIGS. 6 and 7, enough space for the processing tools may be created.

For carrying out such shifting of products, the supporting means must be designed variable and corresponding controlling and driving means, e.g. guiding rails, must be provided.

Figure 8:
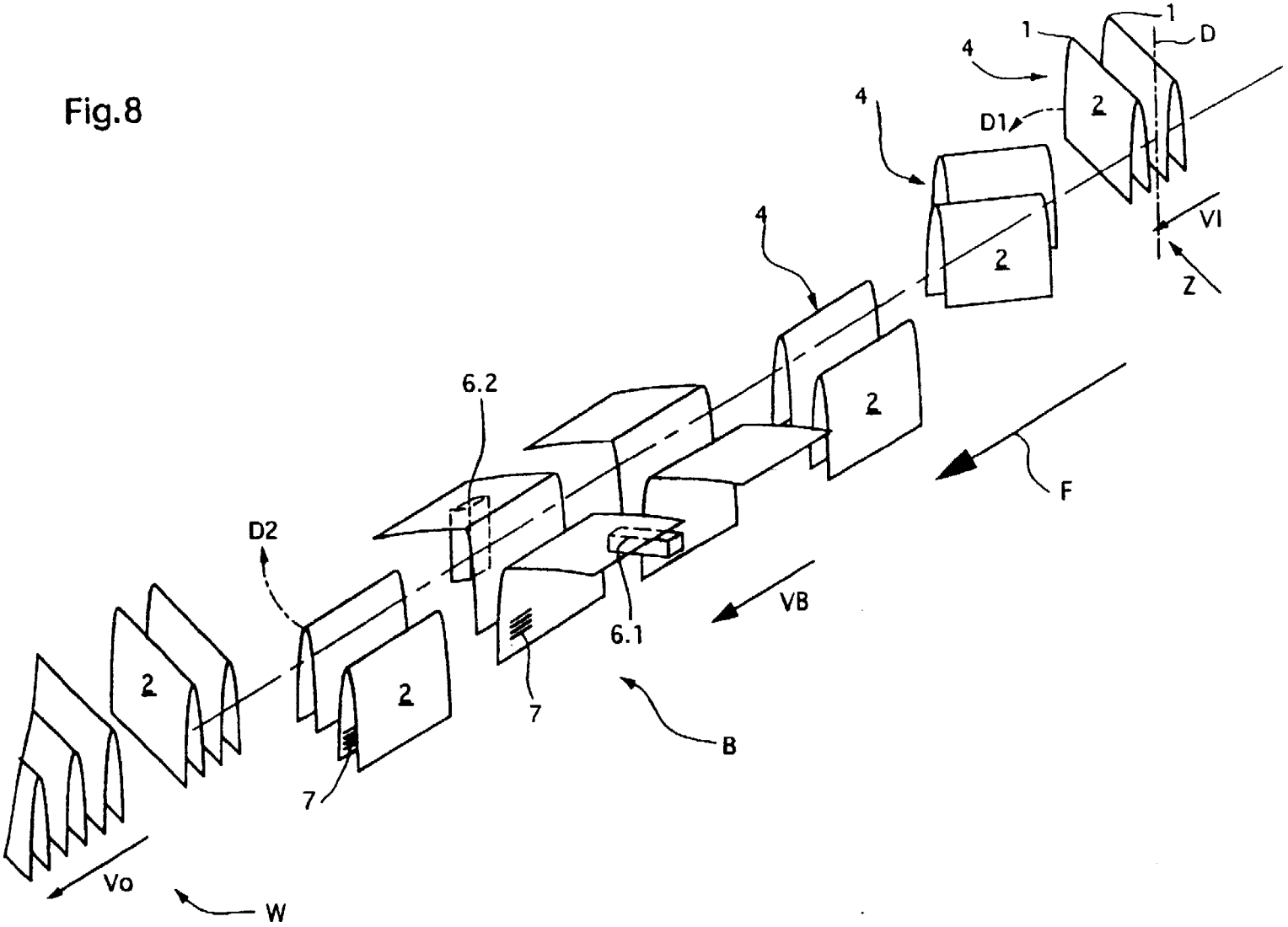
FIG. 8 is a schematic perspective view of the inventive method applied to products consisting of a plurality of pages wherein processing consists of printing on one of the inside pages with the help of a writing head.

FIG. 8 shows a variant of the inventive method in a diagrammatic threedimensional view which variant substantially corresponds to the method according to FIG. 1.

Printed products 1 are conveyed (supply stream) as a condensed product stream, wherein their main surfaces 2 are substantially perpendicular to the conveying direction (arrow F). Then the printed products 1 are rotated in successive groups 4, whereby a group 4 generally comprises one or several (shown: two) printed products 1. After the rotation the main surfaces 2 of the products are substantially parallel to the conveying direction F. The distances between successive printed products 1 in a product group 4 can remain the same as in the supply stream; the distances between product groups 4, in the shown case, are enlarged before, during or immediately after the rotation. This means that the product groups 4 are accelerated from their supply speed $v_I$ to a higher processing speed $v_B>v_I$.

Then the products are processed in groups. In this case this means that the two products of each group are opened in a diametrically opposed manner by tools which are not shown and are printed-on on one of their inner pages with writing heads 6.1 and 6.2, e.g. with a personalized text or an address 7. The writing heads are arranged outside the conveying stream to be substantially stationary. It has to be noted that for printing on identical pages the writing heads are to be arranged not in the way of mirror images. Obviously it would also be possible to process one of the main surfaces, e.g. to print on it before or after opening the products.

The processed printed products 1 are then closed again and rotated in groups such that their main surfaces 2 are again arranged substantially perpendicular to the conveying direction F. During or immediately after rotation the conveying speed is also reduced ($v_o<v_B$), advantageously to the supply speed ($v_o=v_I$) and the products are conveyed away (removal stream).

FIG. 9 is a schematic plan view of part of a device for carrying out the method variant according to FIG. 8; only the part of the device is shown in which the products are supplied, rotated, opened and printed. The conveying direction F is from left to right.

FIG. 9 especially shows an example of supporting means. These are members with two arms 11 arranged parallel to each other and mounted to a body 12. Body 12 can be rotated around a rotation axis D with the help of a control lever 13. Control lever 13 carries a guide wheel 14 running along a corresponding guiding rail (broken line 15).

In area Z of the supply stream, the supporting means are in such a position of rotation that their arms 11 are positioned perpendicular to the conveying direction F and they are spaced such that the distances between all arms 11 are identical. In this area printed products 1 with a plurality of pages or in the form of folded sheets are shifted onto the arms 11 of the supporting means 10 e.g. by parallel and synchronously guided supports 16 of a collecting drum (not shown). The driving means for this shifting movement are e.g. arrangements for axial shifting of printed products such as used in collecting drums according to the state of the art.

In the area of the first rotation D.1 the distances between the supporting means are enlarged by an increase of the conveying speed such that there is sufficient space in processing stream B for the arms oriented in conveying direction F. In the area of processing stream B the products 1 hanging on the arms are opened and printed on their insides with the help of writing heads 6.1 and 6.2.

FIG. 10 shows further parts of the same device as shown in FIG. 9 as a side elevation. Supporting means 10 with body 12, arms 11, control lever 13 and guide wheel 14 are again visible. The products 1 hanging on arms 11 are also shown.

Supporting means 10 are fitted to every second link 21 of a link chain 20 such that they can be rotated round a rotation axis D. Link chain 20 serves as connecting means for supporting means 10 the length of which is variable between the supporting means. The distance between the supporting means in conveying direction is e.g. varied by variation of the distances or successive links 21 perpendicular to the conveying direction F. This kind of control can be realized e.g. with rolls 22 arranged on links 21 which rolls 22 run on a pair of corresponding rails (shown with broken pairs of lines 23/24 and 25/26) when the chain is pulled in conveying direction.

Instead of guiding rails 23/24 and 25/26 other controlling and/or driving means can be used, e.g. driving chains or driving wheels arranged parallel to the conveying direction of the supporting means and equipped with equidistant engaging means (e.g. teeth) with the help of which the driving chain or wheel cooperates with the link chain. In areas with different speeds means with differently spaced engaging means are used.

If only two different conveying speeds are necessary for carrying out the inventive method (e.g. method variants according to FIGS. 2 and 3) a link chain, as shown in FIG. 10, can also comprise limit stops which define the shortest as well as the longest distances in conveying direction between links. This kind of chain, each second link of which runs on a guiding rail, automatically has its shortest configuration when pushed and its longest configuration when drawn such that the distance between links and with it the distance between product groups can be controlled by the mode of driving (pushed or drawn).

Other embodiments of driving mechanisms for supporting means 10 for carrying out the inventive method are known to one skilled in the art and can be applied correspondingly.

Figure 11:
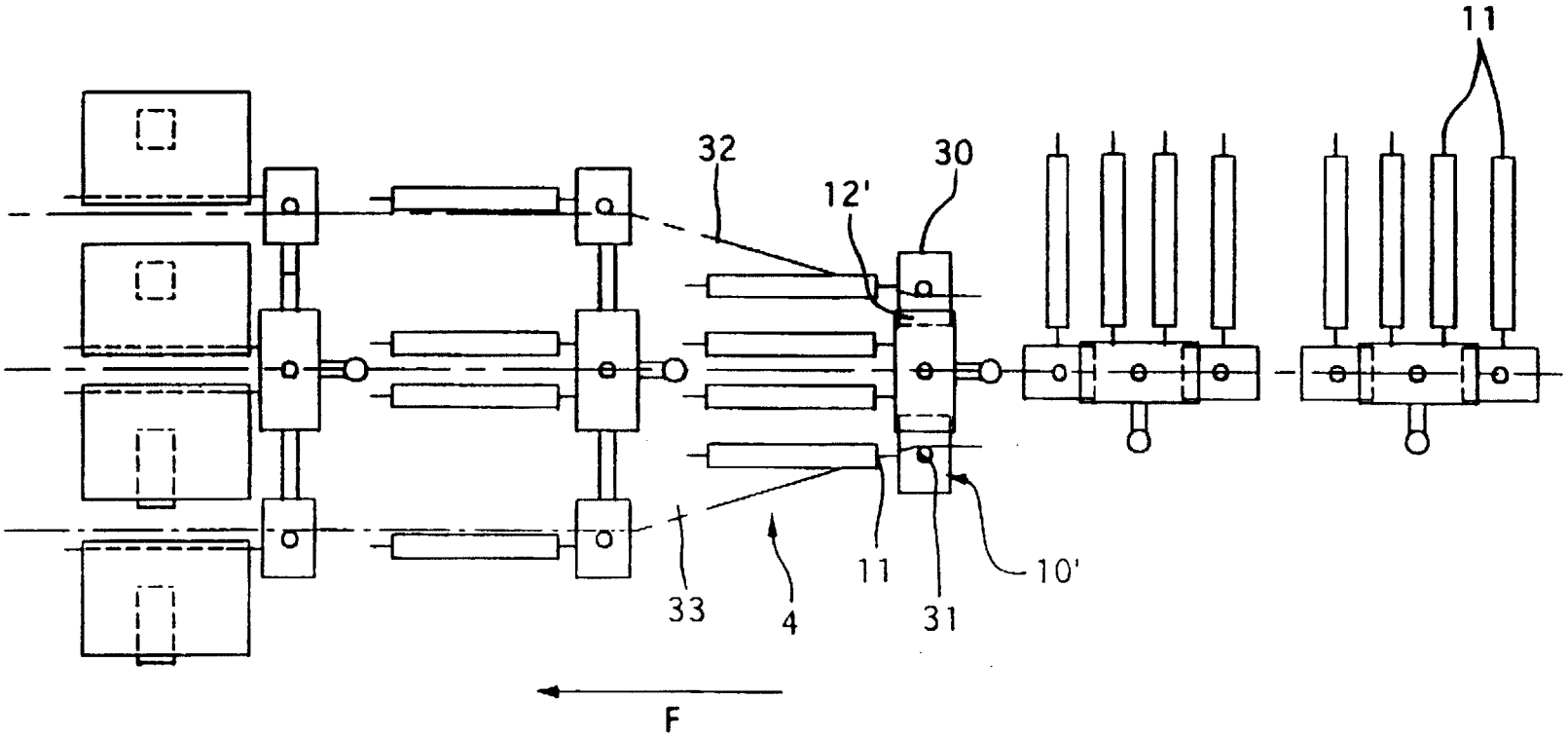
FIG. 11 is a schematic plan view of a device for carrying out a method according to FIG. 8 with four products per processing group and with a changing of the relative arrangement of the products in the processing group.

FIG. 11 shows in a similar way as FIG. 9 a further method variant. In this variant each product group 4 comprises four products and the distances between the products are partly enlarged for processing, as is also shown in FIG. 6. The supporting means 10' required for this method variant comprise four arms 11.

For enlarging the distances between the products in the processing groups bodies 12' of the supporting means are equipped with extractable side parts 30 on both sides, whereby on each extractable side part 30 an arm 1 is arranged. Each of these side parts 30 is e.g. equipped with a control roll 31 and readjusting means (not shown), whereby the control rolls run along a guiding rail (shown diagrammatically as broken lines 32 and 33). Guiding rails 32 and 33 are arranged upstream of the processing station such that side parts 30 are extracted when this area is passed.

For changing the relative position of the products in the processing groups, as shown in FIG. 7, analogue supporting means and controlling means are to be provided.

According to all Figures straight conveying lines are shown for carrying out the inventive method. This however does not mean that the invention is restricted to straight conveying lines. Obviously the method variants can also be carried out with conveying lines curved in any direction.

I claim:

1. A method for processing printed products, each product having two main surfaces which are significantly larger than other surfaces of the product, comprising the steps of supplying the products in a supply stream to a rotation location with main surfaces substantially perpendicular to a conveying direction while holding the products by a supporting means, transforming the supply stream into a processing stream by rotating groups of products while holding the products with the supporting means about a rotation axis lying in a plane substantially parallel to the main surfaces of the products in a group, whereby in the processing stream the main surfaces of the products are substantially parallel with the conveying direction, conveying the processing stream to a processing location, processing the products in groups, and conveying the products away from the processing location.

2. A method according to claim 1 and including, after the step of processing the products, the step of transforming the processing stream into a removal stream by rotating the products about a second axis lying in a plane substantially parallel with the main surfaces of the products until the main surfaces are substantially perpendicular with a conveying direction.

3. A method according to claim 2 including increasing conveying speed of products in the processing stream relative to conveying speed of the supply stream, thereby increasing distances between the groups of products, and decreasing conveying speed of products in the removal stream relative to the processing stream, thereby reducing spacing between groups of products.

4. A method according to claim 3 wherein distances between products within a group are reduced for rotation.

5. A method according to claim 2 including decreasing conveying speed of products in the processing stream relative to conveying speed of the supply stream, thereby decreasing distances between the groups of products, and increasing conveying speed of products in the removal stream relative to the processing stream, thereby increasing distances between groups of products.

6. A method according to claim 5 wherein distances between products within a group are increased for rotation.

7. A method according to claim 1 wherein printed products in the product groups are staggered for processing.

8. A method according to claim 1 wherein the printed products are conveyed past substantially stationary processing tools for processing.

9. A method according to claim 1 wherein the step of processing includes printing on the main surfaces.

10. A method according to claim 1 wherein the step of processing comprises opening the product, and printing on an inside page of the product.

11. A method according to claim 1 wherein each group of printed products consists of one printed product only.

12. A device for processing printed products, each product having two main surfaces which are significantly larger than other surfaces of the product, comprising the combination of a conveyor;

a plurality of supporting means coupled to said conveyor for conveying products in a conveying direction in a supply stream to a rotation location with main surfaces of said products substantially perpendicular to said conveying direction, each of said supporting means including means for supporting a group of printed products;

means for rotating said supporting means about a rotation axis for transforming said supply stream into a processing stream, said rotation axis lying in a plane substantially parallel to said main surfaces of said products in a group, whereby in said processing stream said main surfaces of said products are substantially parallel with said conveying direction, and means for processing said products in groups.

13. A device according to claim 12 wherein each said supporting means comprises a body and arms extending from said body for suspending printed products.

14. A device according to claim 12 including a guide rail, and wherein said supporting means comprises a control lever carrying a guide roll guided along said rail for rotating said supporting means.

15. A device according to claim 13 wherein each said body comprises an extractable side part for changing distances between products or positions of products in said product groups, and control means for extracting said side part.

16. A device according to claim 15 wherein said control means comprises control rolls and guiding rails.

17. A device according to claim 16 wherein said each said supporting means is connected to said conveyor and means for driving said conveyor at a constant speed.

18. A device according to claim 17 and including connecting means having variable length interconnecting said supporting means.

19. A device according to claim 18 wherein said connecting means comprises a link chain and wherein a supporting means is connected to every second link of said chain.

20. A device according to claim 19 wherein said control rolls are mounted on said links and run in said guiding rails.

21. A device according to claim 19 wherein said chain links comprise limit stops for establishing a chain configuration with first, short distances between links and a chain configuration with second, longer distance between links and that the distances between links are adjusted by pushing or pulling motions.

* * * * *